US007110563B2

(12) United States Patent
Bergere

(10) Patent No.: US 7,110,563 B2
(45) Date of Patent: Sep. 19, 2006

(54) HEADPHONE

(75) Inventor: Julien Laurent Bergere, Leuven (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 192 days.

(21) Appl. No.: 10/506,286

(22) PCT Filed: Feb. 7, 2003

(86) PCT No.: PCT/IB03/00490

§ 371 (c)(1),
(2), (4) Date: Aug. 31, 2004

(87) PCT Pub. No.: WO03/075604

PCT Pub. Date: Sep. 12, 2003

(65) Prior Publication Data

US 2005/0084129 A1 Apr. 21, 2005

(30) Foreign Application Priority Data

Mar. 6, 2002 (EP) ..... 02075862

(51) Int. Cl.
*H04R 25/00* (2006.01)

(52) U.S. Cl. ..... 381/380; 381/371; 381/382

(58) Field of Classification Search ..... 381/60, 381/309, 338, 370, 371, 372, 373, 374, 380, 381/381, 382; 379/430; 181/129, 130, 135
See application file for complete search history.

(56) References Cited

U.S. PATENT DOCUMENTS 4,239,945 A * 12/1980 Atoji et al. ..... 381/371
6,259,796 B1 * 7/2001 Lin ..... 381/371
2006/0067555 A1 * 3/2006 Tsai ..... 381/380

* cited by examiner

*Primary Examiner*—Huyen Le

(57) ABSTRACT

Headphones or earphones are commonly known as electro-acoustic transducers used by a single listener. The invention relates to combing insert and non-insert electro-acoustic transducers in a headphone element. In this way a combination of a wide-low frequency reproduction (insert type) and a wide-high frequency reproduction (non-insert type) are obtained.

13 Claims, 3 Drawing Sheets

HEADPHONE

Figure 1:
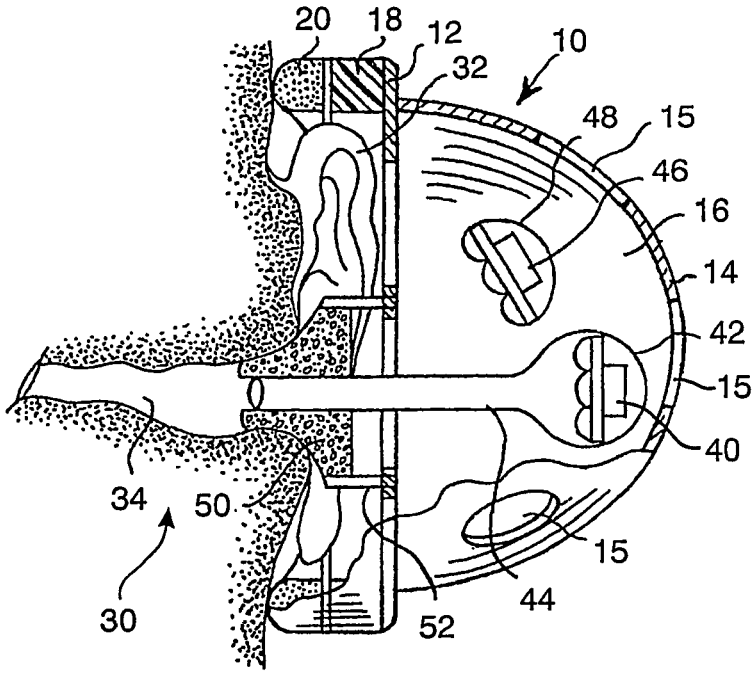

The present invention relates to the technical field of headphones or earphones, in particular the present invention relates to a novel technique of improving the frequency response of the headphone or headphone set as compared to a headphone or headphone set not including the novel technical features characteristic of the present invention.

Within the audio and hi-fi industry, headphones or earphones are commonly known as electro-acoustic transducers used by a single listener for the reproduction of sound of music to the one individual or listener. Conventionally, a headphone or a headphone set includes separate headphone elements for each of the ears of the listener. The headphone elements of the headphone set may constitute separate elements to be positioned at or in the ears of a listener or may alternatively include a mechanical element often known as a spring band interconnecting the two headphone elements and maintaining the headphone elements in their intentional position juxtaposed the ears of a listener, as the spring band conventionally allows adjustment of the position of the individual headphone elements for adjustment of the position of the headphone elements relative to the size of the head of the listener and the position of the ears on the head of the listener. The headphone elements may, according to different technical approaches constitute acoustically open elements or acoustically closed elements. The acoustically open elements allow the transducer or transducers of the headphone element or headphone elements to radiate sound to the surroundings, whereas the acoustically closed headphone elements are concealed within a closed housing.

Within this technical field, the term a headphone included within a housing being an open or a closed structure and in this context, the term headphone element is construed covering technically equivalent phenomena, such as headphone capsule, a headphone transducer, assembly, etc. Within this technical field, different terms such as headphones, earphones, headsets etc. are commonly used and the present invention relates to these technical phenomena covered by the above terms and, in the present context referred to as headphone technology. Within this technical field, various approaches for providing wide range reproduction have been developed including structures ranging from small ear canal insert techniques to large membrane open ear loudspeaker techniques. The patent literature and the technical literature includes a fairly large number of references describing the variety of techniques referred to above.

It is a task of acoustic developing engineers to provide a wide frequency response for headphones or earphones including one or more electro-acoustic transducer, in particular when the dimensions of the electro-acoustic transducer or transducers are limited. Most often, the frequency response of small earphones is limited to 100 Hz–10 kHz (−3 dB cut-off) or even more restricted. Certain techniques have been developed for increasing the frequency response towards high and low frequencies.

It is an object of the present invention to provide an improved headphone element of a headphone set, which headphone element allows the listener wearing the headphone set including a pair of headphone elements to perceive a wide frequency response reproduction by the use of one or more small diameter electro-acoustic transducers providing a wider frequency response as compared to the prior art techniques and providing a frequency response ranging from the lower frequency limits obtainable by the best low frequency reproduction techniques known in the art to the high frequency limit range obtainable by the best high frequency reproduction techniques known in the art.

A particular advantage of the present invention relates to the fact that a wide frequency response is obtainable in a headphone set including a pair of headphone elements in which a fairly small electro-acoustic transducer is used, providing, according to the teachings of the present invention, an improved low frequency range reproduction as compared to the low frequency reproduction obtainable in accordance with the prior art techniques by means of the electro-acoustic transducer element itself.

A headphone element for use by a listener wearing the headphone element or a headphone set including a pair of headphone elements and including:

a headphone element support to be positioned juxtaposed the outer ear of the listener, a first transducer element supported by the support and including a tube for the transmission of sound generated by the first transducer element therethrough for radiation from an output end of the tube, a porous ear piece for positioning the output end of the tube at the entry of the auditory canal of the ear of the listener for the radiation of sound from the output end of the tube into the auditory canal, the porous ear piece allowing the transmission of sound therethrough without a substantial attenuation of the sound transmission and a second transducer element supported by the support and being positioned for the radiation of sound to the entry into the auditory canal of the listener through the porous ear piece.

The above object and the above advantage together with numerous other objects, advantages and features which will be evident from the below detailed:

The porous ear piece allows by the very property of its acoustic resistance, the transmission of sound coming from out of the auditory canal into the auditory canal without any substantial attenuation of the sound transmission and at the same time provides through its sealing property, a pressure to be built up inside the auditory canal for the sound which is brought inside it through the tube.

Basically, the present invention is originating from the idea of combining insert and non-insert electro-acoustic transducers in a headphone element. In other words, the teachings of the present invention allows the combination of the wide low frequency reproduction of an insert in type headphone element and the wide high frequency reproduction obtainable in a free air like non-insert headphone. The key to the combination of the two different techniques relating to insert and non-insert headphones providing advantageous low frequency and high frequency reproduction characteristics, respectively, is the provision of the porous ear piece. Since the ear piece is porous, it is to a high degree, acoustically transparent allowing the radiation from the second transducer element to be transmitted into the auditory canal of the listener and at the same time provides the insert type coupling between the first transducer element and the auditory canal of the listener.

According to the teachings of the present invention, the first and second transducer elements may be constituted by separate transducers, as the first transducer element may be constituted by a low frequency reproducing transducer and the second transducer element may be constituted by a high frequency reproducing transducer. In this two way reproduction system, the individual low and high frequency reproducing transducers may be designed for low and high frequency reproduction exclusively and optimised for the low and high frequency reproduction, respectively.

Alternatively, in a simple and more low cost embodiment, the first and second transducer elements are constituted by a single transducer, as the one side of the transducer constitutes the first transducer element and the other side of the transducer constitutes the second transducer element. In this alternative embodiment, the front side of the transducer facing the porous ear piece constitutes the high frequency reproducing second transducer element, whereas the rear side of the transducer connected to the low frequency transmission tube constitutes the low frequency reproducing first transducer element.

The transducer elements of the headphone element according to the present invention may be implemented in accordance with any relevant electro-acoustic principal, e.g. and preferably as electro-dynamic transducers. Alternatively, capacitive, piezo-ceramique, magneto-dynamic, electro-static etc. transducer principals may be used in the transducer elements of the headphone element according to the present invention.

The acoustic transmission from the first transducer element constituting the low frequency reproducing transducer element, is preferably established by housing the first transducer element being constituted by a separate transducer or alternatively the one side of a single transducer within a sealed enclosure, allowing the radiation from the one side of the first transducer element to be transmitted through the tube.

Provided a single transducer be used according to the above embodiment in which the radiation from the one transducer be used as the first transducer element, the headphone element support is in a simple and light weight structure by the sealed enclosure itself.

The headphone element may, in accordance with techniques well known in the art per se, be configurated as closed or open structures as the headphone element housing according to a first embodiment may constitute a closed housing in which the first and second transducer elements are supported and seal off the interior of the housing from the surroundings.

Alternatively and preferably, in an open headphone element structure the headphone element support constituting an acoustically open structure allowing the second transducer element to acoustically communicate with the surroundings. According to a further advantageous embodiment, a porous plug is positioned within the tube and terminating the tube at the output end thereof for providing a semi-open tube, thereby damping the low frequency resonance of the tube providing a bass response as compared to an embodiment not included in the porous plug.

In the above described first embodiment having separate transducers constituting the first and the second transducer element, the separate low and high frequency reproducing transducers may as discussed above, be configurated and designed for low frequency and high frequency reproduction, respectively, and the first transducer element constituting the low frequency reproducing transducer having a pair of electrical input terminals may advantageously and preferably be connected through the first set of electrical input terminals to an electrical low pass filter and similarly, the second transducer element constituting the high frequency reproducing transducer having a second pair of electrical input terminals may be connected through the second set of electrical input terminals to an electrical high pass filter as is well known in the art per se from the technique of designing loudspeaker crossovers. The electrical filters connected to the first and second transducer elements may further, as is also well known in the art per se include attenuators, volume controls, impedance equalizing circuitry or networks, notch filters, band pass filters, frequency shaping networks etc.

According to the basic of the present invention, the porous ear piece characteristic of the present invention is designed for, on the one hand, positioning the low frequency transmission tube in or at the entry into the auditory canal of the ear of the listener and on the other hand, allowing acoustic transmission without any substantial attenuation from the high frequency reproducing second transducer element into the auditory canal of the ear of the listener. According to the basic teachings of the present invention, the porous ear piece may be configurated for the insertion into the entry of the auditory canal of the ear of the listener or alternatively be configurated for positioning the output end of the tube at the entry of the auditory canal of the listener.

The teachings of the present allows, as described above, the reproduction of a wide range frequency band at a high sound pressure level utilising small size electro-acoustic transducers, such as 10–30 mm diameter electro-dynamic transducers. The combination of acoustic output from the first and the second transducer elements allows the first and the second transducer elements or the electronic circuitry connected to the separate transducers constituting these elements to provide within the auditory canal of the listener, an audio frequency response extending from below 100 Hz to above 10 kHz (−3 dB frequencies), preferably from below 50 Hz, further preferably below 30 Hz to above preferably 15 kHz, further preferably above 20 kHz.

The present invention also relates to a headphone set, i.e. a headphone including a pair of headphone elements, one for each ear, which elements are implemented in accordance with the teachings of the present invention as described above.

Figure 2:
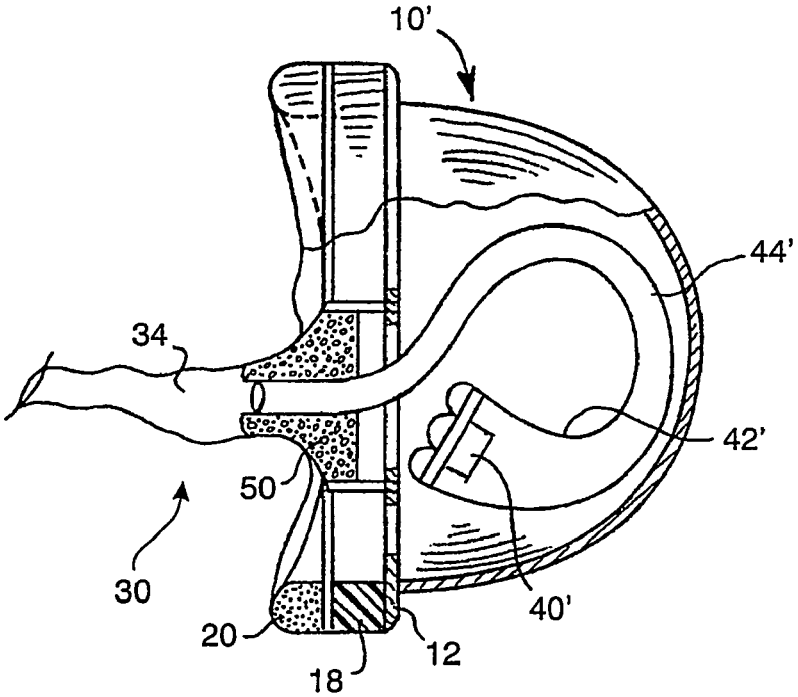
Figure 3:
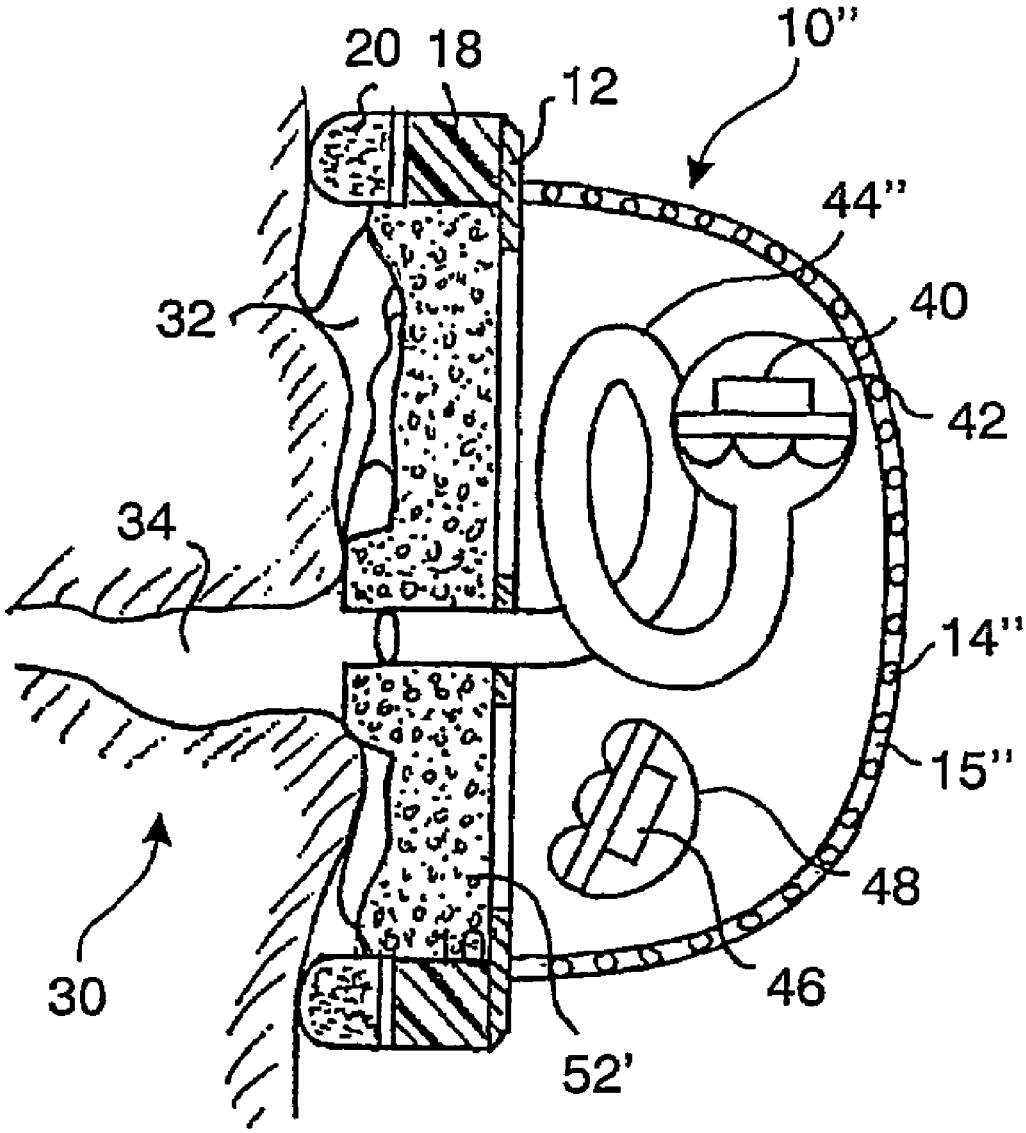
Figure 4:
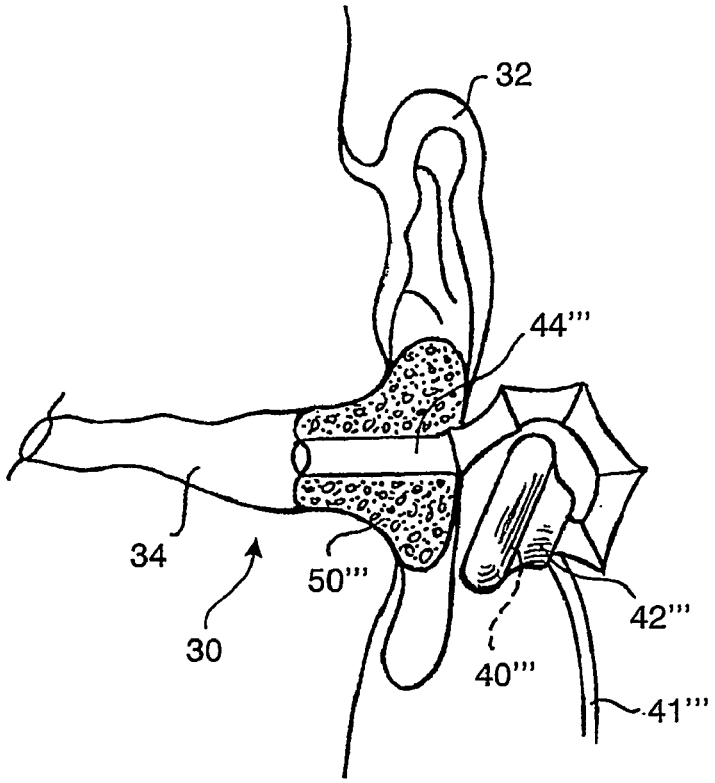
Figure 5:
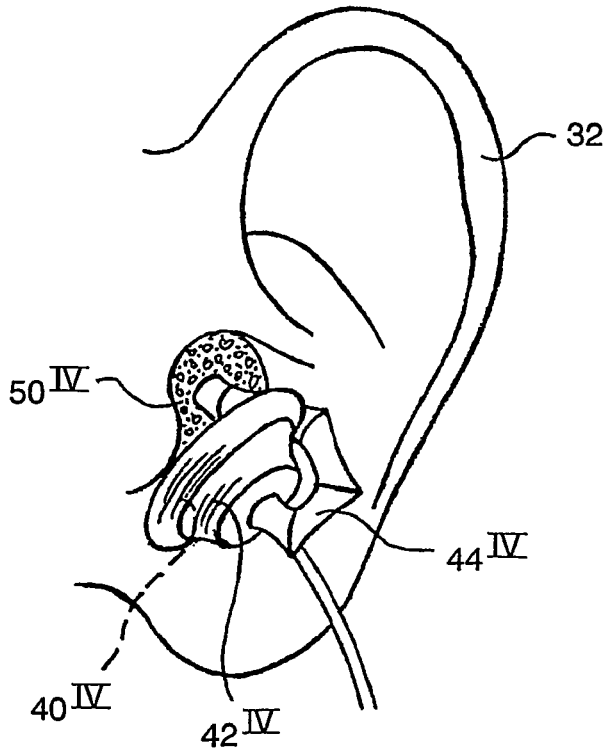

The invention is now to be further described with reference to the drawings, in which FIG. 1 is a schematic and vertical sectional view of a first embodiment of the headphone element according to the present invention, also illustrating the coupling to the auditory canal of a listener, FIG. 2 is a schematic and vertical sectional view similar to the view of FIG. 2 of a second embodiment of the headphone element according to the present invention, FIG. 3 is a schematic and vertical sectional view of a third embodiment of the headphone element according to the present invention, FIG. 4 is a schematic and vertical sectional view illustrating a prototype embodiment or fourth embodiment of the headphone element according to the present invention, and, FIG. 5 is a schematic and vertical sectional view of a further prototype embodiment or fifth embodiment of the headphone element according to the present invention.

In the present context, the technique of improving the low frequency response of a transducer of a headphone or earphone is described with reference to schematic embodiments and further a prototype embodiment.

In FIG. 1, a headphone or headphone element designated the reference numeral 10 in its entirety is shown constituting the one headphone element of a pair of headphones. The element 10 comprises two housing parts, including an annular housing part 12 and a dome-shaped housing part 14 connected to the one side or outer side of the annular housing part 12. The dome-shaped housing part 14 as is shown in FIG. 1 provided with a plurality of apertures 15 for providing an acoustically open structure in which acoustical communication is established from within the housing part 14 to the surroundings. From the opposite side or inner side of the annular housing part 12, a ring-shaped body 18 of an elastomere material protrudes towards the head of a listener and is connected to a soft sealing-off ring 20 establishing connection to the head of the listener for improving the comfort of the person or listener carrying the headphone set.

The head of the listener is schematically illustrated in FIG. 1 and is its entirety designated the reference numeral 30 and comprises an outer ear 32 received within the ring-shaped body 18 and the sealing-off ring 20 and also an auditory canal 34.

For establishing sound reproduction, a pair of transducers 40 and 46 are provided constituting a low frequency reproducing transducer and a high frequency reproducing transducer, respectively, i.e. constituting a two channel sound reproduction system. The low frequency reproduction transducer 40 is included within a bulb-shaped enclosure 42 separating the radiation from the one side of the transducer from the radiation from the opposite side of the transducer.

The bulb-shaped enclosure 42 is connected to an elongated tube 44 through which the low frequency radiation from the transducer 40 is transmitted to the auditory canal 34 of the listener as the bulb 44 is fixated at the entry of the auditory canal 34 by means of a porous ear piece 50 of a foamed material, which ear piece allows acoustic transmission of high frequency radiation from the high frequency transducer 46, the rear side of which is sealed-off by means of a dome-shaped closure 48. The high frequency radiation from the transducer 46 is directed towards the porous ear piece 50 for the transmission of the high frequency radiation through the porous ear piece into the auditory canal 34. In the acoustically open headphone structure, the radiation from the high frequency transducer 46, is also radiated through the apertures 15 of the housing part 14 to the surroundings. The porous ear piece 50 is in the embodiment shown in FIG. 1 fixated to the annular housing part 12 by means of a continuous wall component or a segmented wall part composed of two or more wall parts, one of which is designated the reference numeral 52 together circumferentially encircling the porous ear piece 50. The mechanical linking between the wall parts 52 and the annular housing part 12 is not illustrated in greater details in FIG. 2, as the provision of additional housing elements establishing the mechanical connection between the wall parts 52 and the annular housing part 12 are readily perceivable by a person having skill in the art.

The basic teachings of the acoustic principal of the present invention is the utilisation of a sound tube earphone for the low frequency reproduction in combination with a high frequency reproducing transducer. The key to the element provision of the combination of the sound tube earphone for the low frequency reproduction and the high frequency reproduction using a different transducer is the usage of the porous ear piece.

For providing a more flat bass response through the attenuation of or damping of low frequency resonances within the low frequency sound transmitting tube 44, a porous plug may be positioned at the output end of the tube 44 for providing a semi-open tube. Alternatively, as illustrated in FIG. 1, the porous plug may be omitted allowing the low frequency reproducing transducer 40 to freely radiate through the tube and into the auditory canal 34.

According to the teachings of the present invention, the combination in the auditory canal of the listener of the low frequency radiation input to the auditory canal through the low frequency transmission tube and the high frequency radiation through the porous ear piece supporting the low frequency transmission tube of the low frequency transducer may be implemented as described above with reference to FIG. 1 by using separate transducers for the low frequency and high frequency reproduction. Alternatively, as illustrated in FIG. 2, a single transducer may be used for the low frequency and the high frequency reproduction.

In FIG. 2, a modified embodiment of the headphone element shown in FIG. 1 is illustrated, which headphone element is designated the reference numeral 10. In the present specification, components or elements identical to components or elements previously described are designated the same reference numeral as the previously described components or elements, whereas a component or element fulfilling the same purpose as previously described component or element, respectively, however differing from the previously described component or element, respectively, is designated the same reference numeral as the previously described component or element, however added a marking for identifying, on the one hand the functional correspondence with the previously described component or element and, on the other hand the difference in shape or geometry. The components or elements included in the embodiments shown in FIGS. 2 and 3 and previously described with reference to FIG. 1 are only described to such extent as needed for the understanding of the description of the embodiments in FIGS. 2 and 3.

Apart from the combination of the two transducers 40 and 46 shown in FIG. 1 into a single transducer 40' in the second embodiment 10' shown in FIG. 2, differs from the above described first embodiment in that the apertures 15 of the housing part 14 is omitted. Consequently, the headphone element shown in FIG. 2 constitute a closed headphone element.

In FIG. 2, the transducers 40 and 46 shown in FIG. 1 are combined into a single transducer 40', the front side of which provides the high frequency radiation transmitted through the porous ear piece 50, whereas the rear side of the transducer 40' is connected through a conical enclosure 42' to an elongated, curved tube 44'. As the person having skill in the art realises, the length of the tube establishing acoustical communication from the low frequency radiation transducer to the auditory canal of the listener determines the low pass cut off frequency of transmission through the transmission tube.

In FIG. 3, a further or third embodiment of the headphone element of the pair of headphones according to the present invention is shown, which embodiment is designated the reference numeral 10" in its entirety. Like the above-described first embodiment 10 shown in FIG. 1, the third embodiment shown in FIG. 3 includes separate transducers for the low frequency and the high frequency reproduction and constitutes an acoustically open structure as the housing part 14" of the headphone element 10" is made from an open mesh structure defining large openings 15". The third embodiment 10" further includes, as distinct from the above described first and second embodiments an enlarged porous ear piece 52' filling out the major part of the enclosure defined between the annular housing part 12 and the outer ear 32 of the listener 30. the enlarged porous ear piece 52' itself provides the mechanical support of the ear piece to the housing part 12 and the ring-shaped body 18.

The third embodiment 10" shown in FIG. 3 further differs from the above-described first embodiment 1 in that the tube 44" establishing the low frequency transmission path from the low frequency reproducing transducer 40 included within the bulb-shaped enclosure 42 has a larger length as compared to the length of the tube 44 shown in FIG. 1 and is configurated into a tube coil.

In FIG. 4, a first prototype embodiment or fourth embodiment of the headphone or earphone element according to the present invention is shown. The first prototype or fourth embodiment of the headphone or earphone element is of a simple structure in which the outer housing parts described above and illustrated in FIGS. 1–3 are omitted as the single transducer element 40''' is housed within a closure 42''' allowing the front side radiation from the transducer to be transmitted through the porous ear plug 50'''. whereas the rear side radiation from the transducer 40''' is transmitted through the tube 44''' extending through the earplug 50''' and in itself constituting the only supporting structure for supporting the headphone element within the ear of the listener. In FIG. 4, an electric cable 41''' is also shown extending from the transducer 40'''.

In FIG. 5, a further or second prototype embodiment or fifth embodiment of the headphone or earphone element according to the present invention is shown, which differs slightly from the above described first prototype embodiment in that the earplug $\mathbf{50}^{IV}$ has a reduced size as compared to the size of the earplug 50''' shown in Fig. allowing the transducer $\mathbf{40}^{IV}$ to rest within the outer ear of the listener rather than having the transducer hanging freely outside the ear of the listener as shown in FIG. 4.

In the above described first and second prototype embodiments, the following components were used:

The transducer was a driver of a dome/cone construction having a 15 mm diameter diaphragm, 16 ohm impedance and a free air resonance frequency of 230 Hz. The sensitivity of the transducer was 75 dB/1 Watt/1 m in an infinite baffle. The dimensions of the tube were: Length 30 mm and inside diameter 2mm.

The invention claimed is:

1. A headphone element for use by a listener wearing the headphone element or a headphone set including a pair of headphone elements and including:

i) a headphone element support to be positioned juxtaposed the outer ear of the listener, ii) a first transducer element supported by the support and including a tube for the transmission of sound generated by the first transducer element therethrough for radiation from an output end of the tube, iii) a porous ear piece for positioning the output end of the tube at the entry of the auditory canal of the ear of the listener for the radiation of sound from the output end of the tube into the auditory canal, the porous ear piece allowing the transmission of sound therethrough without a substantial attenuation of the sound transmission and iv) a second transducer element supported by the support and being positioned for the radiation of sound to the entry into the auditory canal of the listener through the porous ear piece.

2. The headphone element according to claim 1, the first transducer element being constituted by a low frequency reproducing transducer and the second transducer element being constituted by a high frequency reproducing transducer.

3. The headphone element according to claim 1, the first and second transducer elements being constituted by a single transducer, the one side of the transducer constituting the first transducer element and the other side of the transducer constituting the second transducer element.

4. The headphone element according to claim 1, the first transducer element being housed within a sealed enclosure allowing the radiation from the one side of the first transducer element to be transmitted through the tube.

5. The headphone element according to claim 4, the headphone element support being constituted by the sealed enclosure.

6. The headphone element according to claim 1, the headphone element support constituting an acoustically open structure allowing the second transducer element to acoustically communicate with the surroundings.

7. The headphone element according to claim 1, the headphone element constituting a closed housing in which the first and second transducer elements are supported and seal-off the interior of the housing from the surroundings.

8. The headphone element according to claim 1, further including a porous plug terminating the tube at the output end thereof for providing a semi-open tube.

9. The headphone element according to claim 1, the first transducer element having a first pair of electrical input terminals being connected through the first set of electrical input terminals to an electrical low pass filter, and the second transducer element having a second pair of electrical input terminals being connected through the second set of electrical input terminals to an electrical high pass filter.

10. The headphone element according to claim 1, the porous ear piece being configurated for the insertion into the entry of the auditory canal of the ear of the listener.

11. The headphone element according to claim 1, the porous ear piece being configurated for positioning the output end of the tube at the entry of the auditory canal of the listener.

12. The headphone element according to claim 1, the first transducer element and the second transducer element together providing within the auditory canal of the listener an audio frequency respond extending from below 100 Hz to above 10 kHz.

13. A headphone set including a pair of headphone elements having any of the features of claim 1.

* * * * *